United States Patent [19]

Manduley et al.

[11] Patent Number: 4,790,120

[45] Date of Patent: Dec. 13, 1988

[54] METHOD OF AND MAILER FOR DELIVERY OF REPLACEMENT UNITS AND RETURN OF REPLACED UNITS

[75] Inventors: Flavio M. Manduley, Woodbury; Paul M. Kasarauskas, Stamford; Norman R. Lilly, Stratford; Kenneth A. Teran, Stamford, all of Conn.

[73] Assignee: Pitney Bowes Inc., Stamford, Conn.

[21] Appl. No.: 18,880

[22] Filed: Feb. 25, 1987

[51] Int. Cl.[4] ..... B65D 73/02

[52] U.S. Cl. ..... 53/468; 206/334; 221/66; 229/921

[58] Field of Search ..... 53/467, 468, 472, 266 C; 229/921; 221/66, 99, 102; 206/334

[56] References Cited

U.S. PATENT DOCUMENTS

| | | | |
|---|---|---|---|
| 3,804,293 | 4/1974 | Redman | 221/66 X |
| 4,046,311 | 9/1977 | Voytko | 229/921 X |
| 4,293,070 | 10/1981 | Ohlbach | 53/472 X |
| 4,415,092 | 11/1983 | Boyer | 221/66 X |
| 4,480,423 | 11/1984 | Müller | 53/266 C |
| 4,539,794 | 9/1985 | Azzaroni | 53/493 |
| 4,724,959 | 2/1988 | Manduley et al. | 206/334 |

*Primary Examiner*—James F. Coan

*Attorney, Agent, or Firm*—Peter Vrahotes; Melvin J. Scolnick; David E. Pitchenik

[57] ABSTRACT

A method and apparatus for the delivery of replacement units, particularly suited for the delivery of replacement electronic components such as Programmable Read-Only Memories (PROM's) mounted on printed circuit boards. The apparatus includes a box-like housing divided into upper and lower regions by a partition. U-shaped track guides containing flexible linkages are fixed to the inner walls of the housing and extend between the upper and lower regions. Each region is accessible through a door which when closed may only be opened by from inside the housing. To deliver a replacement unit the replacement unit is inserted into the track guides in the lower region and the lower door is closed. The housing is then wrapped, with the upper door open, with shrinkable plastic, or other suitable material. A customer's address and any necessary mailing permits are fixed to the wrapping and the whole is mailed to the customer. When the customer receives the mailed apparatus he removes the wrapper and inserts the replaced unit into the track guides in the upper region. As the replaced unit is inserted the flexible linkages force the replacement unit forward through the lower door so the customer may remove it. Since a return address and necessary mail permits are fixed to the outside of the housing the customer need only then close the doors and deposit the housing in the mail.

8 Claims, 4 Drawing Sheets

METHOD OF AND MAILER FOR DELIVERY OF REPLACEMENT UNITS AND RETURN OF REPLACED UNITS

BACKGROUND OF THE INVENTION

1. Field of the Invention.

This invention relates to a method and apparatus for delivery of replacement units and return of the replaced units. More particularly, it relates to a method and apparatus for delivery of replacement units which comprise electronic components such as PROM's mounted on printed circuit boards to form modules, and for return of such modules.

Postal scales and the like are well known. Such scales determine the weight of items to be mailed and from this weight, together with information which may be input by an operator, determine the charges for mailing the item in accordance with rates stored in the scale. Typically, such scales are controlled by a microprocessor and rates for the USPS and/or other carriers such as UPS are stored in the processor memory. The operation of such postal scales is well known and need not be described further here for an understanding of the subject invention.

Typically, PROM's are used as the rate memory for such postal scales. PROM's offer several advantages for this purpose. They are non-volatile, which allows easy delivery of new rates to customers, and they are easily programmable so that new rate memories may be manufactured quickly in the event of a rate change. PROM's are also relatively expensive and reusable and it is a considerable savings to vendors of postal scales if they can obtain the return of the old replaced PROM's from their customers when rates are changed. Some vendors will impose a substantial charge on their customers who fail to return the PROM's while others, for marketing reasons, will absorb the cost of unreturned PROM's themselves.

With the proliferation of private courier type carriers and the expected increase in the frequency of rate changes, it is apparent that the costs of this problem can be expected to increase in the future.

Accordingly, it is an object of the present invention to provide a way whereby replacement units maybe delivered to a customer and replaced units returned to the vendor; in particular where such units are PROM modules used in postal scales or the like.

It is another object of the subject invention to provide a method and apparatus which minimize the efforts of a customer while facilitating and encouraging return of the replaced units.

It is another object of the subject invention to provide a method and apparatus whereby the replacement units may be delivered through the mails an the replaced units returned through the mails without need for the customer to address the replaced units before returning them.

SUMMARY OF THE INVENTION

The above objects are achieved and the disadvantages of the prior art are overcome in accordance with the present invention by a mailer for delivery of replacement units and return of replaced units. The mailer includes a housing having an opening for insertion of the replaced unit, and a security device in which the replaced unit must be inserted to release the replacement unit and which holds the replaced unit within the housing.

In a preferred embodiment of the present invention, the address to which the replacement unit is to be delivered is printed or otherwise marked on a heat-shrinkable covering for the mailer which must be removed in order to insert the replaced unit and release the replacement unit from the mailer.

In another preferred embodiment of the subject invention, the return address of a vendor is embossed, printed, or otherwise shown on the surface of the mailer and the only address visible once the replaced unit is inserted into the mailer is the return address and the customer does not need to address the mailer before returning it.

In another preferred embodiment of the subject invention, the mailer has a pair of spaced, opposed walls with U-shaped guide tracks fixed to the inner surfaces of the walls for receiving and guiding the replacement unit as it is inserted. The U-shaped guide tracks contain flexible linkages which move as pressure is applied to them.

The present invention is used by a customer who receives a replacement unit contained in a mailer, the unit being held in the mailer by a door which cannot be opened by the customer from the outside, and inserts the replaced unit into the mailer; releasing the replacement unit and holding the replaced unit within the mailer. The customer then removes the released replacement unit from the mailer, installs it in place of the replaced unit, and returns the mailer with the replaced unit to a recipient.

All of the above embodiments are preferred for use with units which include electronic components, such as PROM's, mounted on a printed circuit board.

Thus, the method and apparatus of the present invention advantageously achieve the above objects since the customer, in the very act of releasing the replacement unit from the mailer, prepares the replaced unit for return to the vendor.

Other objects and advantages of the present invention will be apparent to those skilled in the art from the attached drawings and the detailed description of preferred embodiments set forth below. Those skilled in the art will also recognize that though the present invention has been described above in terms of customers and vendors, these terms are not intended to imply a buyer/seller relationship or to exclude the involvement of third parties.

DETAILED DESCRIPTION OF THE PREFERRED EMBODIMENT

Figure 1A:
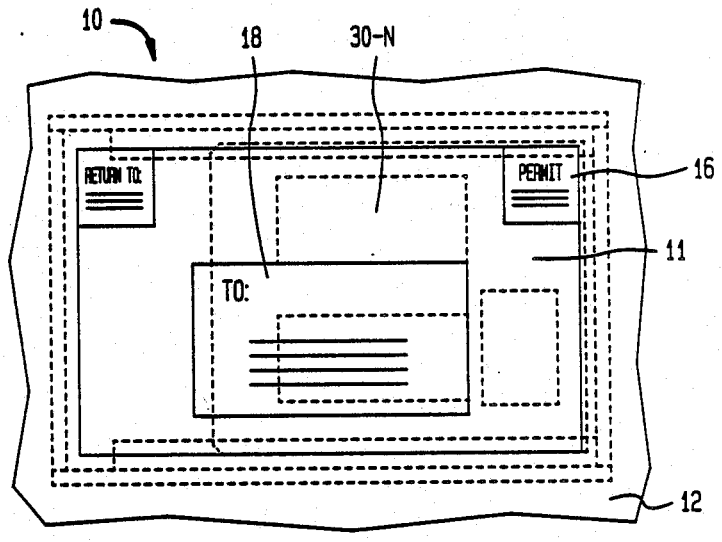
FIG. 1A shows a plan view of a mailer to be sent to a customer with plastic wrapping partially broken away and unwrapped.
Figure 1B:
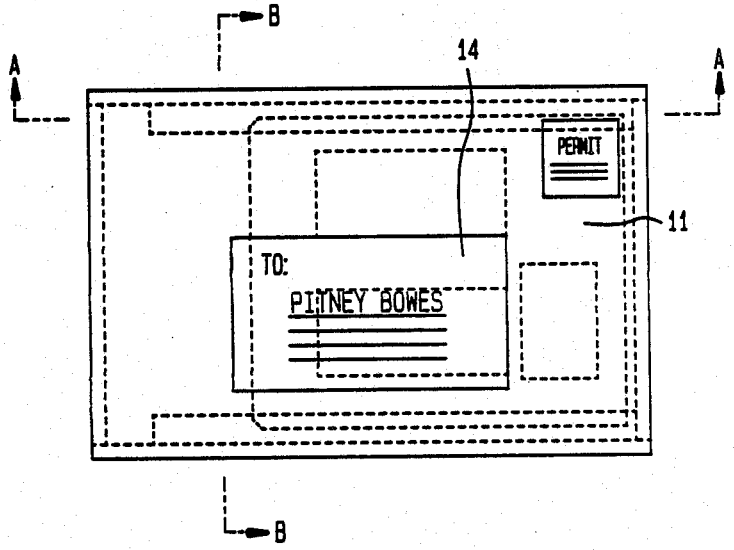
FIG. 1B shows a plan view of a mailer to be sent to vendor.

FIG. 1A and 1B show a plan view of a mailer 10 which contains a replacement PROM Module 30-N, shown in phantom. Mailer 10 includes a housing 11 which is either a unitary piece or multiple pieces connected together in any of several manners, such as glue or snaps, which are well known in the art, formed from a high strength static resistant plastic. Housing 11 includes address 14 of a vendor embossed on the surface. Heat shrinkable plastic wrapping 12, shown partially broken away and unwrapped, surrounds the housing 11 securely. Customer address label 18 and indicia 16, representing a mailing permit, are affixed to plastic wrapping 12.

Figure 2A:
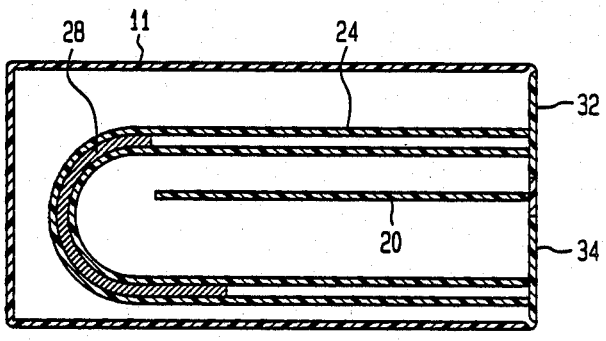
FIG. 2A is a cross-section view of the mailer of FIG. 1B taken along line A—A.
Figure 2B:
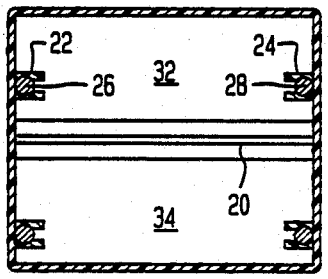
FIG. 2B is a cross-section of the mailer of FIG. 1B taken along line B—B.

Other elements of the preferred embodiment of the subject invention may be understood more closely by reference to the cross-section views of FIGS. 2A and 2B. PROM Module 32-N is held in position beneath a horizontal resilient plastic inner wall 20. Printed circuit board 32-N fits into dual track guides 22 and 24 which restrain module 32-N horizontally. Flexible linkage 26 and 28 are sufficiently long to force the replacement prom 32-N through door 34. The flexible linkages 26 and 18 can be no longer than the length of tracks 22 and 24, less sufficient length allowing replacement prom 32-N to be housed.

Upper door 32 and lower door 34 in housing 11 of mailer 10 allow insertion of replaced module 30-0 and removal of replacement module 30-N. Upper door 32 is preferably shipped in an open position. Lower door 34 is shipped closed and has no means for opening from the outside. Lower door 34 only opens from a force applied from inside mailer 10. Inner wall 20 prevents tampering with new prom 30-N; as will be more fully described below.

Figure 3A:
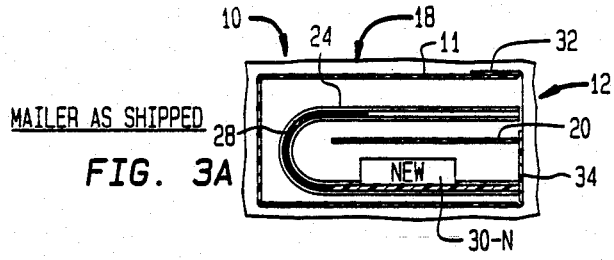
FIGS. 3A through 3F are semi-schematic representations of steps involved in a method of using the mailer of the subject invention.
Figure 3B:
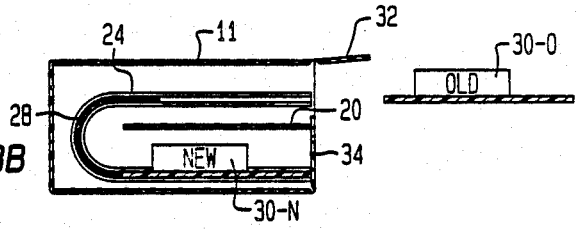

Turning to FIGS. 3A through 3F, the replacement or return process in accordance with the subject invention is shown in schematic form. A vendor who wishes to provide a customer with replacement PROM modules affixes an appropriate address label 18 and indicia 16 to the heat shrinkable plastic covering. The vendor then need only deposit mailer 10 with the USPS, or other suitable carrier, for delivery to the customer. As shown in FIG. 3A, the customer will receive module 10 containing replacement module 30-N. As shown in FIG. 3A, upper door 32 is shipped in open for user access. The customer removes wrapping 12 surrounding module 10. In FIG. 3B, module 30-0 is prepared for insertion into mailer 10 through door 32.

Figure 3C:
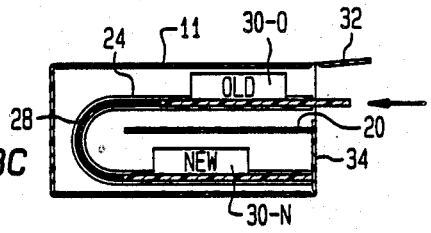

In FIG. 3C, module 30-0 moves along tracks 22 and 24 until contact is made with flexible linkages 26 and 28. Additional pressure on the replaced prom 30-0 forces the flexible linkages 26 and 28 to move through the guide tracks 22 and 24; transferring the force to module 30-N.

Figure 3D:
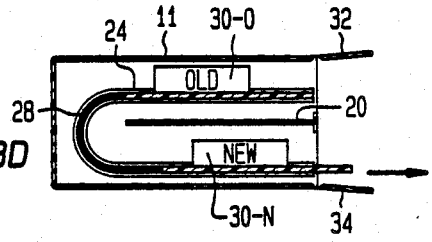

As shown in FIG. 3D, as additional force is applied to module 30-0, movement of flexible linkages 26 and 28 results in the movement of the new prom module 30-N; forcing lower door 34 open. Complete insertion of module 30-0 further displaces 30-N causing it to project through lower door 34.

Figure 3E:
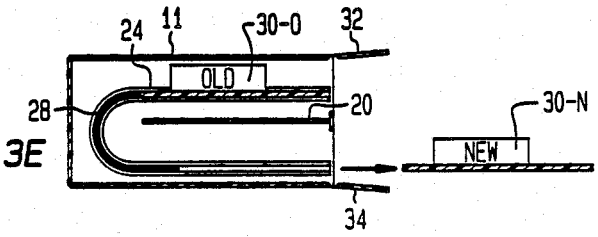

As can be seen in FIG. 3E, the new prom 30-N may be removed from mailer 10. Module 30-0 is secured within mailer 10 contained in tracks 22 and 24. Inner wall 20 provides a barrier between the areas in which prom modules 30-0 and 30-N are stored; to prevent removal of module 30-N except by insertion of module 30-0.

Figure 3F:
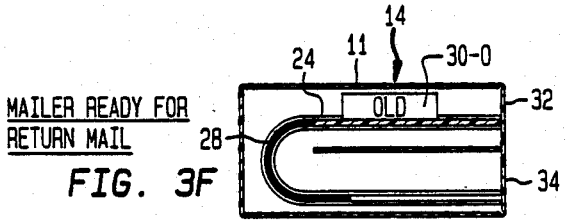

As shown in FIG. 3F, old prom module 30-0 is housing securely within the mailer 10. Address 14 of the vendor is embossed on housing 11. The user closes upper door 32 and lower door 34. Thus, when mailer 10 is deposited with the USPS, or other carrier, it will be returned to the vendor at the return address printed on the mailer 10.

Figure 4:
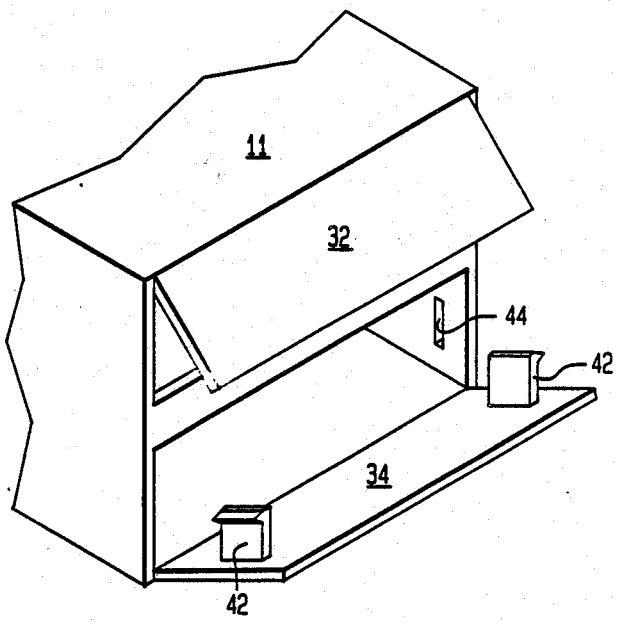
FIG. 4 is a perspective detail view of the doors in the mailer.

In FIG. 4, upper door 32 and lower door 34 are shown partially open. Tabs 42 connects with slots 44 so as not to allow lower door 34 to open unless sufficient pressure from inside is applied. Lower door 34 is flush with surface of housing 11 preventing access from the outside. When door 32 is closed access from the outside is no longer possible because tabs 42 engage slots 44 and prevent opening.

Thus, it may be seen that the method and apparatus of the subject invention provide an effective way in which replacement units may be delivered to, and replaced units returned from, a customer with minimal effort or involvement on the part of the customer. Those skilled in the art will, however, realize that the preferred embodiments described above have been provided by way of illustration only and other embodiments in accordance with the subject invention will be apparent to them from consideration of the teachings set forth above and the attached drawings. Accordingly, limitations on the scope of the subject invention are to be found in the claims set forth below.

What is claimed is:

1. A mailer for delivery of a replacement unit and return of a replaced unit, comprising:

(a) a housing, said housing having a pair of spaced, opposed walls and an opening for insertion of said replaced unit;

(b) first indicia representative of the address to which said replacement unit is to be delivered affixed to said housing;

(c) second indicia representative of the address to which said replaced unit is to be returned affixed to said mailer.

(d) means for holding said replacement unit within said housing and for responding to insertion of said replaced unit to release said replacement unit, said housing means further comprising guide means fixed to the inner surfaces of said walls for receiving and guiding said replaced unit as it is inserted; and (e) said guide means including track guides enclosing flexible linkages whereby said replaced unit will, when partially inserted into said housing, bear on said flexible linkages, said flexible linkages shaped such that force applied to said flexible linkages is transferred to said replacement unit to force said replacement unit out of said housing;

wherein said units each comprise a printed circuit board.

2. A mailer as described in claim 1 wherein indicia representative of the address to which the replaced unit is to be returned are fixed to the surface of said mailer.

3. A mailer as described in claim 2 wherein said guide means includes track guides said track guides enclosing flexible linkages; so that said replaced unit will, when partially inserted into said housing, bear on said flexible linkages; and so shaped that force applied to said flexible linkages is transferred to said replacement unit and forces said replacement unit out of said housing.

4. A mailer as described in claim 1 wherein first indicia representative of the address to which said replacement unit is to be delivered are affixed to the surface of a covering for said housing.

5. A mailer as described in claim 63 wherein an inner wall parallel to the widest surface of said mailer provides a barrier between the areas in which said replaced prom modules and said replacement prom modules are held.

6. A method for replacing units comprising the steps (a) receiving a replacement unit contained in a mailer, said replacement unit being held in said mailer within track guides; said track guides containing flexible linkages; said flexible linkages responding to insertion of a replaced unit to transfer force to said replacement unit;

(b) inserting a replaced unit into said track guides of said mailer, whereby said flexible linkages respond to insertion of said replacement unit to release said replacement unit, said replaced unit being hold within said mailer by said track guides;

(c) removing said released replacement unit from said mailer and installing it in place of said replaced unit; and, (d) returning said mailer and said replaced unit held therein to a recipient.

7. A method as described in claim 6 wherein:

(a) first indicia representative of the address to which said replacement unit is to be delivered are affixed to the surface of a covering of said mailer; and, (b) second indicia representative of the address of said recipient are affixed to the surface of said mailer.

8. A mailer for delivery of a replacement unit and return of a replaced unit comprising:

(a) a pair of spaced, opposed walls; and (b) means, fixed to said walls, for holding said replacement unit within said housing and for responding to insertion of said replaced unit to release said replacement unit, wherein said holding means guide said replacement unit as it is inserted and include flexible linkages; said flexible linkages responding to force applied to said flexible linkages by inserting said replaced unit to force said replacement unit out of said housing wherein said units each comprise a printed circuit board.

* * * * *